US007257344B2

(12) United States Patent
Kim

(10) Patent No.: US 7,257,344 B2
(45) Date of Patent: Aug. 14, 2007

(54) CARRIER VAPOR CLEANER, A WET TYPE ELECTROPHOTOGRAPHIC IMAGE FORMING APPARATUS HAVING THE SAME, AND A CARRIER VAPOR CLEANING METHOD

(75) Inventor: Myoung-chan Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/201,171

(22) Filed: Aug. 11, 2005

(65) Prior Publication Data

US 2006/0045557 A1 Mar. 2, 2006

(30) Foreign Application Priority Data

Aug. 27, 2004 (KR) ..... 10-2004-0067935

(51) Int. Cl.
*G03G 21/20* (2006.01)

(52) U.S. Cl. ..... 399/92

(58) Field of Classification Search ..... 399/91–93
See application file for complete search history.

(56) References Cited

U.S. PATENT DOCUMENTS

| | | | | |
|---|---|---|---|---|
| 4,176,162 | A | 11/1979 | Stern | |
| 2004/0037582 | A1* | 2/2004 | Shin | 399/93 |
| 2004/0105697 | A1* | 6/2004 | Choi et al. | 399/93 |
| 2004/0146314 | A1* | 7/2004 | Yon et al. | 399/93 |

FOREIGN PATENT DOCUMENTS

| | | |
|---|---|---|
| JP | 01-183680 | 7/1989 |
| JP | 01-183681 | 7/1989 |
| JP | 03-196177 | 8/1991 |
| KR | 1020040022944 | 3/2004 |
| KR | 1020040048521 | 6/2004 |

OTHER PUBLICATIONS

Klobucar JM: "Pollutant Destruction: Compraing Thermal-Oxidizer Designs", Chemical Engineering, McGraw-Hill, Albany, NY, US, Feb. 2002, pp. 62-67, XP001205061, ISSN: 0009-2460.

* cited by examiner

*Primary Examiner*—David M. Gray
*Assistant Examiner*—Ryan Gleitz
(74) *Attorney, Agent, or Firm*—Roylance, Abrams, Berdo & Goodman, L.L.P.

(57) ABSTRACT

A cleaning apparatus for use in a wet type electrophotographic image forming apparatus has a duct which guides a fluid to the outside, the fluid containing an ozone and a carrier vapor which are respectively generated from a fusing part and a printing engine having a developing unit and a transfer unit, a fan for forcibly discharging the fluid through the duct, a carrier vapor combustion unit which burns a high concentration of carrier vapor of the fusing part inside the duct and accordingly lowers the concentration and increases the temperature of the carrier vapor of the fluid which is circulated by the fan, and an oxidation catalyst body for increasing a rate of the oxidation of the fluid which is heated by the combustion unit.

22 Claims, 7 Drawing Sheets

CARRIER VAPOR CLEANER, A WET TYPE ELECTROPHOTOGRAPHIC IMAGE FORMING APPARATUS HAVING THE SAME, AND A CARRIER VAPOR CLEANING METHOD

CROSS-REFERENCE TO RELATED APPLICATIONS

This application claims benefit under 35 U.S.C. § 119(a) from Korean Patent Application No. 2004-67935, filed on Aug. 27, 2004, the entire content of which is incorporated herein by reference.

BACKGROUND OF THE INVENTION

1. Field of the Invention

The present invention relates to a carrier cleaning apparatus which cleans carrier vapor when it is generated from a wet type electrophotographic image forming apparatus, and a wet type electrophotographic image forming apparatus having the same.

2. Description of the Related Art

Generally, a wet type electrophotographic image forming apparatus irradiates a laser beam onto an image bearing body such as a photosensitive drum to form an electrostatic latent image thereon. A developer liquid is attached to the electrostatic latent image and therefore visualizes the latent image. The visualized image is transferred onto a predetermined paper sheet, representing an intended image form. The wet type electrophotographic image forming apparatus has a relatively clearer image than a dry type which uses toner powder, and therefore, is more suitable for the printing of color images.

FIG. 1 is a schematic view of a conventional wet type electrophotographic image forming apparatus.

As shown in FIG. 1, a conventional wet type electrophotographic image forming apparatus 10 comprises an image forming apparatus body 11, a plurality of photosensitive drums 12, 13, 14, 15 on which electrostatic latent images are formed, a plurality of electrifying devices 22, 23, 24, 25 which charge the respective photosensitive drums 12, 13, 14, 15 to a predetermined voltage, a plurality of light exposure devices 32, 33, 34, 35 which irradiate laser beams onto the electrified photosensitive drums 12, 13, 14, 15, respectively, a plurality of developing units 52, 53, 54, 55 which visualize the images onto the photosensitive drums 12, 13, 14, 15 by supplying developer liquid, a plurality of first transfer rollers 62, 63, 64, 65 which transfer visible images of the photosensitive drums 12, 13, 14, 15 onto a transfer belt 60, a second transfer roller 66 which transfers a final form of the image of overlapped unit images of the transfer belt 60 onto a paper sheet 'P' as fed, and a fusing part 70 which fixes the final image onto the paper 'P' with heat and pressure.

The developing units 52, 53, 54, 55 store developer liquids of different colors, and supply different color developer liquids to the photosensitive drums 12, 13, 14, 15, respectively. The developer liquid contains an ink with toner distributed therein, and a liquid carrier such as Norpar. Norpar is a solvent of hydrocarbon group, which contains mixtures of elements such as $C_{10}H_{22}$, $C_{11}H_{24}$, $C_{12}H_{26}$, $C_{13}H_{28}$. After the developer liquid is attached onto the respective photosensitive drums 12, 13, 14, 15 to visualize the unit images, the visualized images are overlappingly transferred onto the transfer belt 60. Accordingly, a final image, which is an overlay of overlapped unit images, is transferred onto the paper 'P'. The developer liquid, especially the ink component of the developer liquid is fixed onto the paper 'P' when the paper 'P' is passed through the fusing device 70. The liquid carrier of the developer liquid is vaporized by the high temperature heat into a flammable hydrocarbon gas such as methane $CH_4$, and dispersed into the air.

Meanwhile, the flammable hydrocarbon gas is categorized into volatile organic compounds, which gives off an offensive odor and pollutes the area when discharged without proper filtering. In an effort to solve such problems, a variety of suggestions have been made to remove the flammable hydrocarbon gas.

As the currently available removing methods, there is a filtering process which physically removes the gas component by using a carbon filter such as active carbon, a direct combustion process which burns off the gas component in the temperatures of between 600° C. to 800° C., and an oxidation process which oxidizes the gas component into water and carbon dioxide by burning the gas component by use of a catalyst in the relatively low temperatures range of 150° C.-400° C.

The filtering process lacks the ability to decompose the carrier. Accordingly, in the filtering process, a carbon filter would be saturated with the carrier after a certain period of use, and therefore, needs be replaced. Furthermore, the direct combustion process has a safety problem related to high temperature heat.

Considering the problems such as the above, the current wet type electrophotographic image forming apparatus mainly uses an oxidation process for carrier vapor removal, and attention has been focused on the efficiency of oxidizing carrier vapor.

SUMMARY OF THE INVENTION

The present invention has been suggested to overcome the above-mentioned problems of the related art, and accordingly, it is an object of the present invention to provide a cleaner apparatus which removes carrier vapor as generated from an image forming apparatus, a wet type electrophotographic image forming apparatus having the same, and a carrier removing method thereof The above aspects and/or other features of the present invention can substantially be achieved by providing a cleaning apparatus for use in a wet type electrophotographic image forming apparatus, comprising a duct which guides a fluid to the outside, the fluid comprising an ozone and a carrier vapor which are respectively generated from a fusing part and a printing engine having a developing unit and a transfer unit; a fan which forcibly discharges the fluid through the duct; a carrier vapor combustion unit which burns a high concentration of carrier vapor of the fusing part inside the duct and accordingly lowers the concentration and increases the temperature of the carrier vapor of the fluid which is circulated by the fan; and an oxidation catalyst body which speeds the oxidation of the fluid which is heated by the combustion unit.

The carrier vapor combustion unit may comprise a carrier vapor conveyance path which guides the high concentration of carrier vapor of the fusing part into a predetermined location of the duct; a pump which is formed on the conveyance path and forcibly conveys the carrier vapor; one or more ejection nozzles which are provided at an end of the conveyance path and fire the carrier vapor; and an igniter which provides a spark to the carrier vapor when the carrier vapor is ejected through the ejection nozzle.

The carrier vapor combustion unit may further comprise a heating wire which is formed adjacent to the ejection nozzles and maintained at a predetermined heated temperature.

A plurality of ejection nozzles may be provided in a predetermined arrangement such that carrier vapor ejected from the respective ejection nozzles collide with each other.

A carrier vapor concentration adjustment unit may further be provided to increase the concentration of the carrier vapor for combustion at the carrier vapor combustion unit.

The carrier vapor concentration adjustment unit may comprise a carrier vapor condenser which liquefies some of the fluid which is supplied into the duct; and a carrier evaporator which heats the liquefied carrier of the condenser and supplies to the carrier vapor combustion unit.

The evaporator may comprise a heating chamber which is connected with the condenser and the carrier vapor combustion unit, respectively; a fabric member which causes the liquefied carrier of the condenser to convey into the heating chamber; and a heater which is formed in the heating chamber to heat the liquefied carrier soaked in the fabric member.

The carrier vapor concentration adjustment unit may further comprise a concentration sensor which measures the concentration of the carrier vapor being ejected from the ejection nozzles; and a heater controller which adjusts the heating amount of the heater in accordance with the measured carrier concentration of the concentration sensor The evaporator may further comprise an insulation member which is formed in the heating chamber to block the heat of the heater from leaking to the outside.

An air heater may further be provided to heat the fluid flowing to the oxidation catalyst body.

A heat exchanger may further be provided to transmit a heat to the oxidation catalyst body, the heat being generated from the combustion of the carrier vapor combustion unit.

According to one aspect of the present invention, a wet type electrophotographic image forming apparatus may comprise a main body; a printing engine provided in the main body, and comprising a developing unit which attaches a developer liquid containing an ink and a carrier onto an image bearing body, and a transfer unit which transfers the developer liquid of the image bearing body onto a printing medium; a fusing part which fixes the transferred developer liquid onto the printing medium with heat and pressure; and a cleaning apparatus which removes an ozone and a carrier vapor being generated from the printing engine and the fusing part. The cleaning apparatus may comprise a duct which guides a fluid to the outside, the fluid containing an ozone and a carrier vapor which are respectively generated from the fusing part and the printing engine, a fan which forcibly discharges the fluid through the duct, a carrier vapor combustion unit which burns a high concentration of carrier vapor of the fusing part inside the duct and accordingly lowers the concentration and increases the temperature of the carrier vapor of the fluid which is circulated by the fan, and an oxidation catalyst body which speeds the oxidation of the fluid which is heated by the combustion unit.

According to another aspect of the present invention, a cleaning method of a wet type electrophotographic image forming apparatus is provided. The method may be applied to clean a fluid which contains an ozone and a carrier vapor generated from a fusing part, and a printing engine having a developing unit and a transfer unit, and may comprise the steps of drawing in the fluid from the printing engine and the fusing part; lowering a concentration of the carrier vapor in the drawn fluid; and oxidizing the fluid which contains the carrier vapor in lowered concentration.

The concentration lowering step may comprise the steps of drawing in a high concentration of carrier vapor from the fusing part, separately from the fluid; ejecting the high concentration of carrier vapor as drawn to the fluid containing the ozone; and burning the high concentration of carrier vapor as ejected.

The ejecting step ejects the carrier vapor through a plurality of ejection nozzles such that the ejected carrier vapors collide with each other.

The burning step may comprise the steps of heating a heating wire which is provided at a location to where the carrier vapor is ejected; and sparking the carrier vapor as the carrier vapor is ejected to the heating wire.

The oxidation step may comprise the main heating step of heating the fluid with combustion heat of the carrier vapor; and the oxidation decomposition step in which the carrier vapor and the ozone are decomposed from the heated fluid through a catalyst.

The oxidation decomposition step may further comprise the sub heating step which heats the fluid with an air heater prior to the carrier vapor combustion.

The oxidation decomposition step may further comprise the catalyst heating step in which the combustion heat is transmitted to the catalyst via a heat exchanger to raise the temperature of the catalyst.

Adjusting the concentration of the ejected carrier vapor to, or higher than a predetermined reference value, may be further provided.

The adjustment step may comprise the steps of condensing the carrier vapor of the drawn fluid; evaporating the condensed carrier liquid and mixing with the ejected carrier vapor; measuring a concentration of the ejected carrier vapor; and raising the heating temperature of the condensed carrier liquid when the measured carrier concentration is lower than the predetermined reference value.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE EXEMPLARY EMBODIMENTS

Hereinafter, exemplary embodiments of the present invention will be described in detail with reference to the accompanying drawings.

Figure 1:
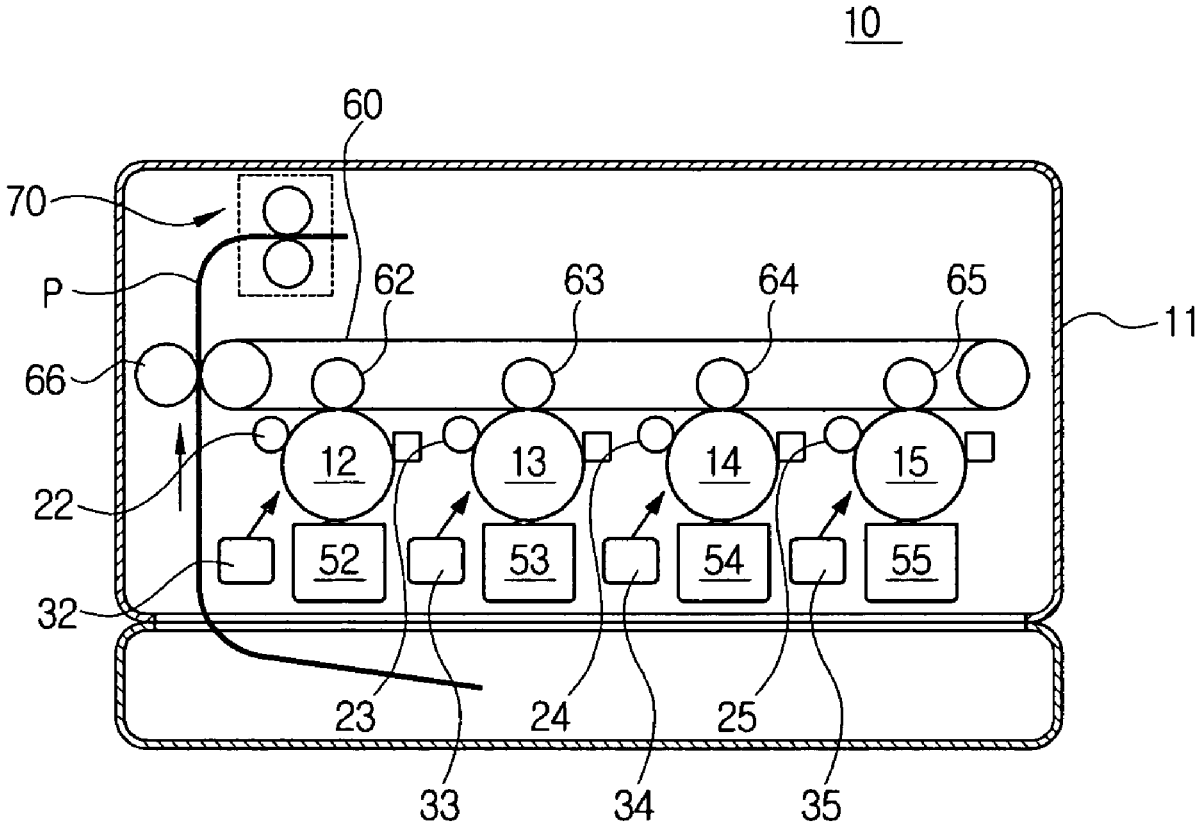
FIG. 1 (PRIOR ART)
FIG. 1 is a schematic view of a conventional wet type electrophotographic image forming apparatus.
Figure 2:
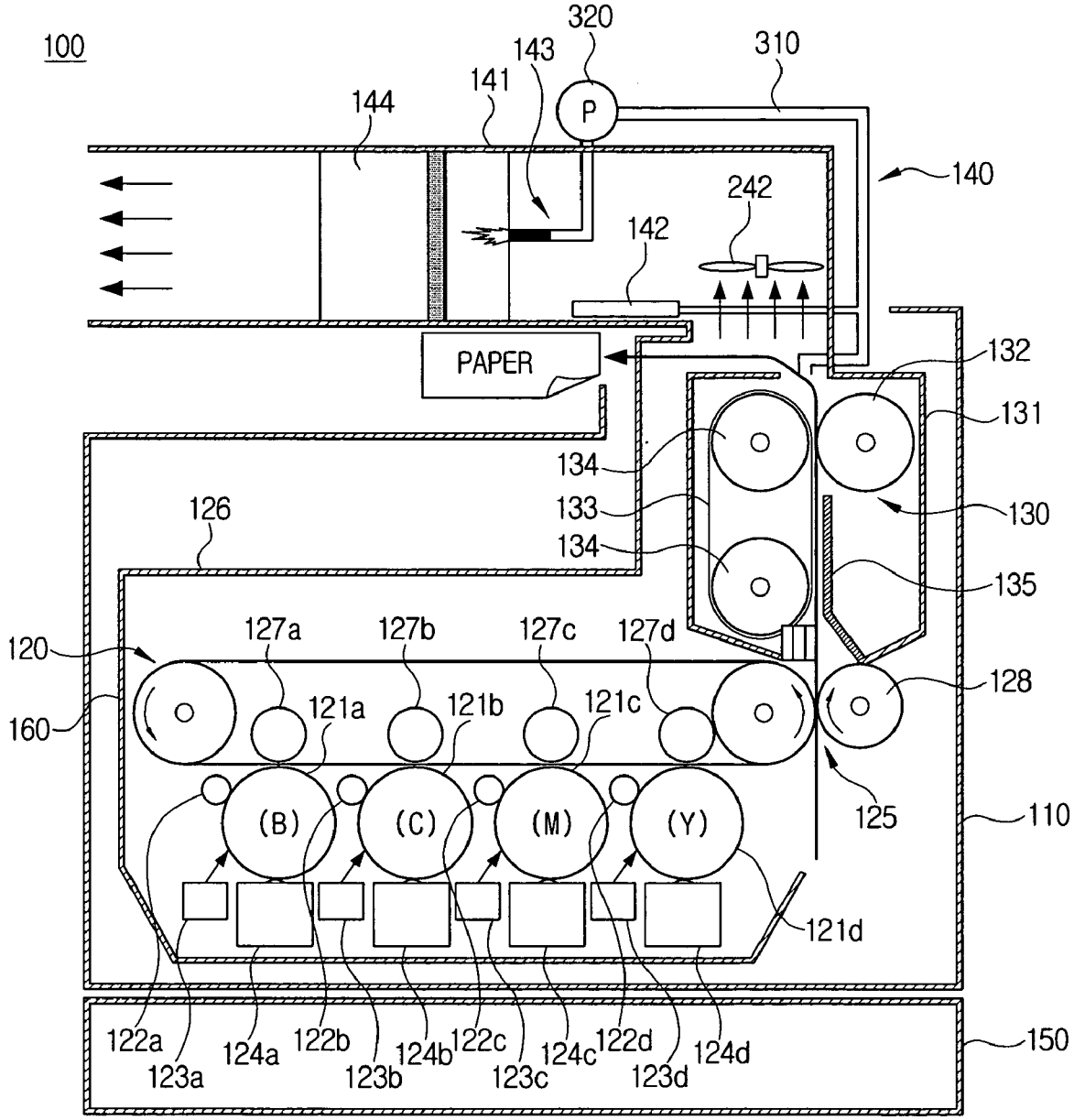
FIG. 2 is a schematic view of a wet type electrophotographic image forming apparatus according to an embodiment of the present invention.
Figure 3:
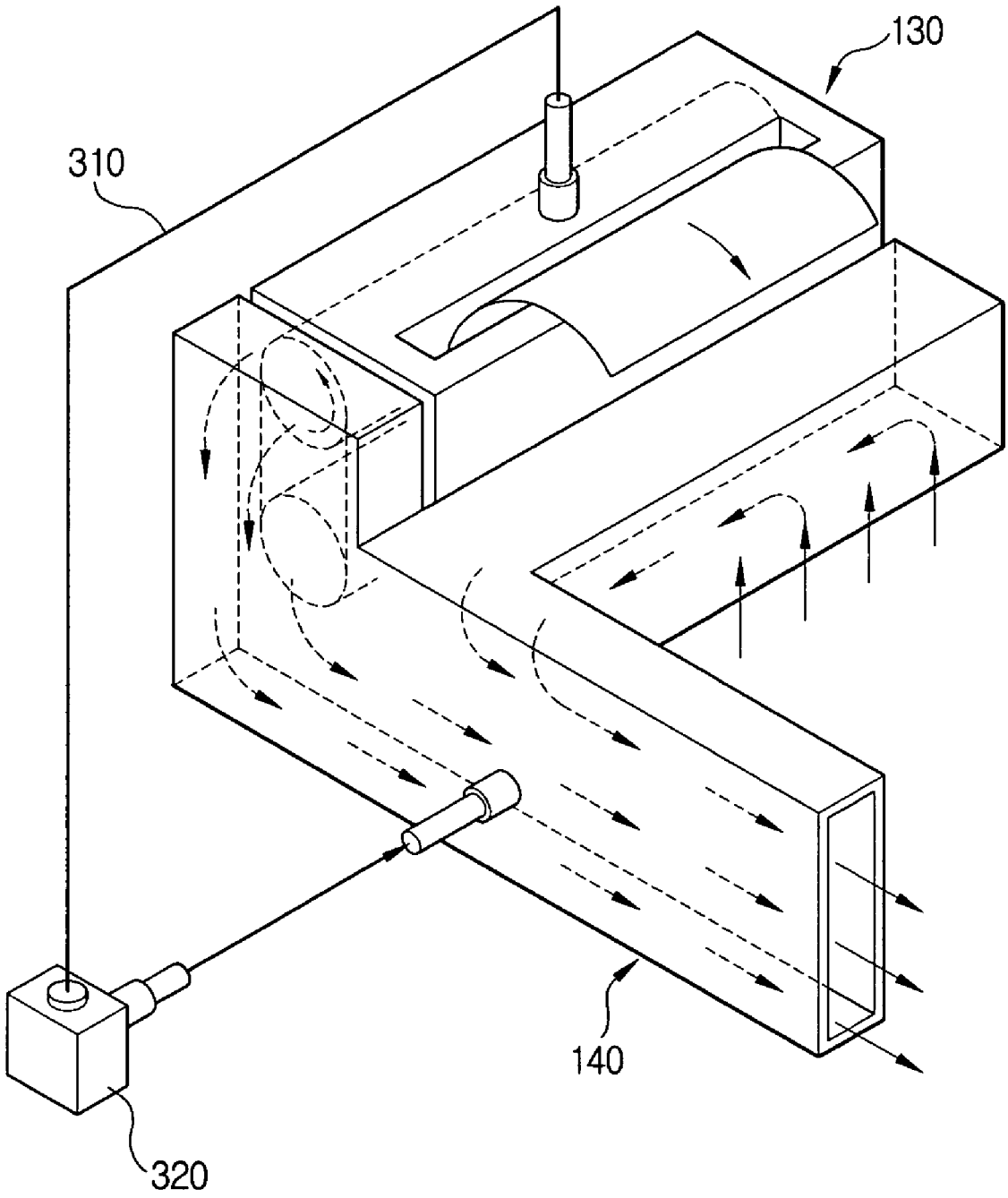
FIG. 3 is a schematic perspective view of a cleaner apparatus of FIG. 2 according to an embodiment of the present invention.

Referring to FIGS. 2 and 3, a wet type electrophotographic image forming apparatus 100 according to an embodiment of the present invention comprises a main body 110 which constitutes an appearance of the image forming apparatus 100, a printing engine 120 which visualizes latent image into visible form and transfers the visible image onto a printing medium 'P' as fed, a fusing part 130 which fixes the transferred visible image onto the printing medium 'P', and a cleaning apparatus 140 which cleans the fluid which is generated from the printing engine 120 and the fusing part 130.

A printing medium feeding unit 150 is provided to the lower part of the main body 110 to supply printing medium 'P' to the printing engine 120.

The printing engine 120 comprises photosensitive drums 121*a*, 121*b*, 121*c*, 121*d* as an image bearing body, electrifying devices 122*a*, 122*b*, 122*c*, 122*d*, light exposure devices 123*a*, 123*b*, 123*c*, 123*d*, developing units 124*a*, 124*b*, 124*c*, 124*d*, and a transfer unit 125.

The electrifying devices 122*a*, 122*b*, 122*c*, 122*d* charge the surfaces of the respective photosensitive drums 121*a*, 121*b*, 121*c*, 121*d* to a predetermined voltage, to form an electrostatic latent image on the surface of the photosensitive drums 121*a*, 121*b*, 121*c*, 121*d*, respectively.

The light exposure devices 123*a*, 123*b*, 123*c*, 123*d* generate a laser beam, and irradiate the laser beam onto the surfaces of the respective photosensitive drums 121*a*, 121*b*, 121*c*, 121*d* which are charged to a predetermined voltage by the electrifying devices 122*a*, 122*b*, 122*c*, 122*d*. As the laser beam hits the surfaces of the photosensitive drums 121*a*, 121*b*, 121*c*, 121*d*, electrostatic latent images are formed on the surfaces of the photosensitive drums 121*a*, 121*b*, 121*c*, 121*d*.

The developing units 124*a*, 124*b*, 124*c*, 124*d* supply developer liquid to the photosensitive drums 121*a*, 121*b*, 121*c*, 121*d*. More specifically, the developing units 124*a*, 124*b*, 124*c*, 124*d* hold developer liquid of different colors such as yellow, magenta, cyan, and black therein, and attached the developer liquid onto the electrostatic latent images of the photosensitive drums 121*a*, 121*b*, 121*c*, 121*d*. As the developer liquid is attached onto the surfaces of the photosensitive drums 121*a*, 121*b*, 121*c*, 121*d*, visible images emerge. Meanwhile, developer liquid contains an ink having toner therein, and a liquid carrier such as Norpar. Norpar is a solvent of hydrocarbon group, which contains mixtures of elements such as $C_{10}H_{22}$, $C_{11}H_{24}$, $C_{12}H_{26}$, $C_{13}H_{28}$, and vaporizes to a flammable hydrocarbon gas such as methane $CH_4$ when heated.

The transfer unit 125 comprises a transfer belt 126 which forms an endless track and which runs in contact with the photosensitive drums 121*a*, 121*b*, 121*c*, 121*d*, a plurality of first transfer rollers 127*a*, 127*b*, 127*c*, 127*d* which transfer visible images of the photosensitive drums 121*a*, 121*b*, 121*c*, 121*d* onto the transfer belt 126, and a second transfer roller 128 which transfers a final image onto the printing medium 'P' when the unit images are overlapped onto the transfer belt 126 into a final image form.

The printing engine 120 constructed as above may be sealed off from the outside by the main body 110, or by a separate sealing chamber 160. The sealing chamber 160 is provide to prevent ozone and carrier vapor from leaking out of the printing engine 120. Of course, the sealing chamber 160 is not strictly necessary. That is, the main body 110 itself may be sealed.

The fusing part 130 evaporates carrier from the developer liquid by applying heat and pressure to the printing medium 'P' bearing the color image, and therefore, fixes the ink component of the developer liquid onto the printing medium 'P'. As shown in FIG. 3, the fusing part 130 comprises a housing 131, a heating roller 132 which is formed inside the housing 131, a pressing belt 133 formed inside the housing 131 to rotate in contact with the heating roller 132, and a pair of pressing rollers 134 which support the pressing belt 133. The heating roller 132 comprises a heat radiating body such as a heating lamp or electrothermal wire to generate high temperature heat. Accordingly, as the transferred image passes the fusing part 130, the liquid carrier such as Norpar instantly vaporizes by the high temperature heat. The vaporized carrier contains water vapor from the printing medium 'P' and also Norpar vapor. The pressing belt 133 is biased by the pressing roller 134 so that the pressing belt 133 maintains tight contact with the heating roller 132 and a supporting pad 135 while running. Alternatively, the pressing belt 133 can be omitted, and one pressing roller 134 and the heating roller 132 may be directly contacted with each other while rotating.

The cleaner apparatus 140 operates to remove ozone and low concentration carrier vapor from the printing engine 120, and to remove high concentration carrier vapor from the fusing part 130. For convenience of explanation, mixture of the ozone and low concentration carrier vapor of the printing engine 120 is called a first fluid, while the mixture of the carrier vapor of the fusing part 130 which is in higher concentration than that of the printing engine 120, with the water vapor, will be called a second fluid. The mixture of first and second fluid will be called a third fluid.

The cleaner apparatus 140 comprises a duct 141 which guides the third fluid to the outside of the main body 110, a fan 142 which forcibly draws in first and second fluid to the duct 141, a carrier vapor combustion unit 143 which conveys the second fluid of the fusing part 130 through the duct 141 to burn it, and an oxidation catalyst body 144 which speeds up the oxidation of the third fluid which is heated by the combustion unit 143.

The duct 141 is connected with one end to the housing 131 of the fusing part 130 and to the sealing chamber 160 which encloses the printing engine 120. Accordingly, the first fluid of the printing engine 120 and the second fluid of the housing 131 are drawn in and mixed at the same time into the third fluid. The duct 141 cleans the third fluid and guides the cleaned fluid to flow outside. Configuration and size of the duct 141 can be varied adequately according to the size and design of the image forming apparatus.

The fan 142 is formed inside the duct 141 to cause the first fluid of the printing engine 120 and the second fluid of the fusing part 130 to flow or circulate toward the oxidation catalyst body 144.

Figure 4:
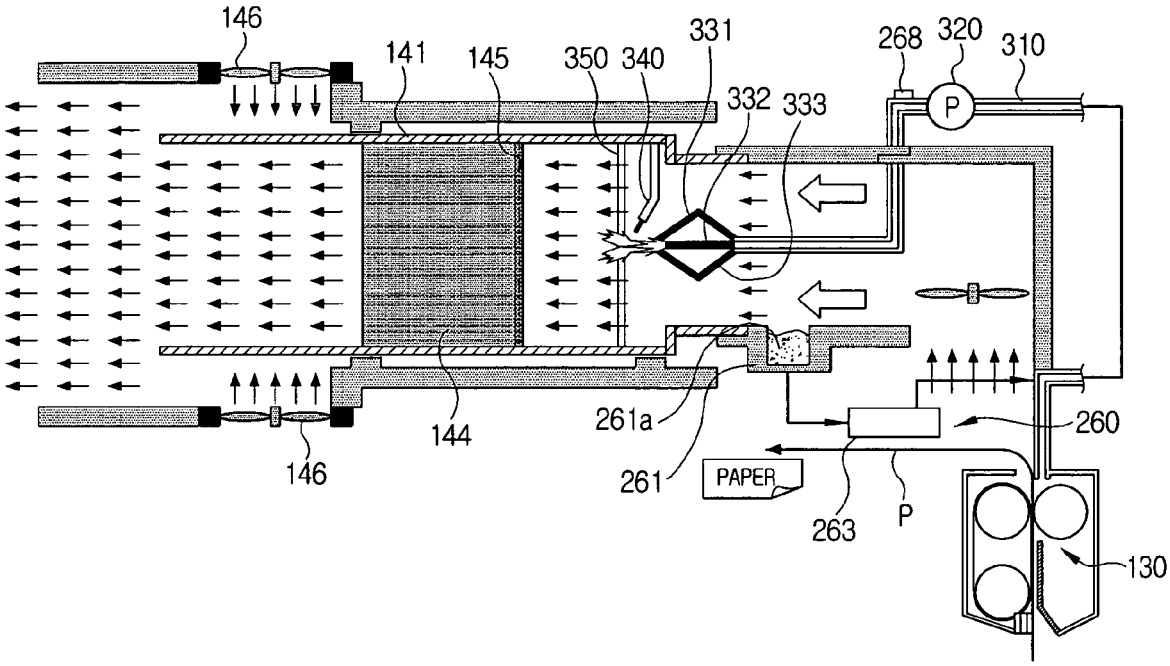
FIG. 4 is a schematic view of a cleaner apparatus of FIG. 3 according to an embodiment of the present invention.

Referring to FIG. 4, the carrier vapor combustion unit 143 comprise a carrier vapor conveyance path 310 which guides the second fluid containing the high concentration carrier vapor of the fusing part 130 into the duct 141, a pump 320 formed on the conveyance path 310, a plurality of ejection nozzles 331, 332, 333 provided at the end of the conveyance path 310, and an igniter 340 which provides a flame, or a spark, to the second fluid being fired out of the ejection nozzles 331, 332, 333.

The conveyance path 310 may be preferably made in the form of a metal pipe which can convey the second fluid and is heat resistant. One end of the conveyance path 310 is arranged at the exit part of the printing medium 'P', that is arranged at the upper part of the fusing part 130. The other end of the conveyance path 310 is arranged in the duct 141, and may preferably be arranged at the front of the oxidation catalyst body 144. Accordingly, when the second fluid is generated from the fusing part 130, some of the high concentration carrier vapor and the water vapor is not mixed with the first fluid, but is separately conveyed into the duct 141 through the conveyance path 310. The pump 320 forcibly draws in the second fluid from the fusing part 130 and forcibly conveys the drawn fluid into the duct 141 with high pressure, and provides ejection pressure so that the second fluid can be fired out through the ejection nozzles 331, 332, 333.

The ejection nozzles 331, 332, 333 emit the second fluid at high pressure, and arranged such that the streams of second fluid from the respective ejection nozzles 331, 332, 333 can collide with each other as being ejected. More specifically, as shown in FIG. 4, one end of the respective ejection nozzles 331, 332, 333 may preferably be faced in the same direction.

The igniter 340 produces a spark at a location where the streams of the second fluid from the respective ejection nozzles 331, 332, 333 collide with each other. Accordingly, among the second fluid, the high concentration carrier vapor can be burned. Because the carrier vapor from the fusing part 130 has an equivalence ratio of $\Phi>1$, which usually enables perfect burn, a spark can result in combustion.

The carrier vapor combustion unit 143 may additionally comprise a heating wire 350 inside the duct 141. More specifically, the heating wire 350 is formed at a location where the spark is produced by the igniter 340. The heating wire 350 is maintained at a predetermined heated temperature, and therefore, as the spark by the igniter 340 executes combustion of the carrier vapor, the heating wire 350 acts to continue and spread the combustion. Accordingly, the high concentration carrier vapor can be completely burned.

A carrier vapor concentration adjustment unit 260 may be additionally provided to increase the concentration of the carrier vapor of the second fluid which is supplied through the conveyance path 310. According to the printing speed and amount of printing data, the concentration of the carrier vapor from the fusing part 130 may vary. Accordingly, by adjusting the concentration of the carrier vapor to exceed, for example, approximately 20% to approximately 30% of the equivalence ratio of 1, combustion of the carrier vapor is enabled.

To this end, the carrier vapor concentration adjustment unit 260 may comprise a condenser 261 which liquefies some carrier vapor of the third fluid flowed to the duct 141, and a carrier evaporator 263 which evaporates the carrier in liquefied state and supplies as the carrier vapor to the combustion unit 143.

The condenser 261 may be formed inside the duct 141 in the form of a duct, to cool the third fluid which is blown into the duct 141 by the fan 142. In this embodiment, the condenser 261 employs a metal material of high heat conductivity as a part of the duct 141. By doing so, the condenser 261 acts to cool down the drawn carrier vapor to liquefied state. That is, among the third fluid which is drawn into the duct 141, there is a high temperature carrier vapor from the fusing part 130 in a saturated state. Therefore, a certain amount of carrier vapor is liquefied while the third fluid passes through the condenser 261. The carrier liquid is collected in a carrier liquid reservoir 261 a which is provided at the lower part of the condenser 261.

Figure 5:
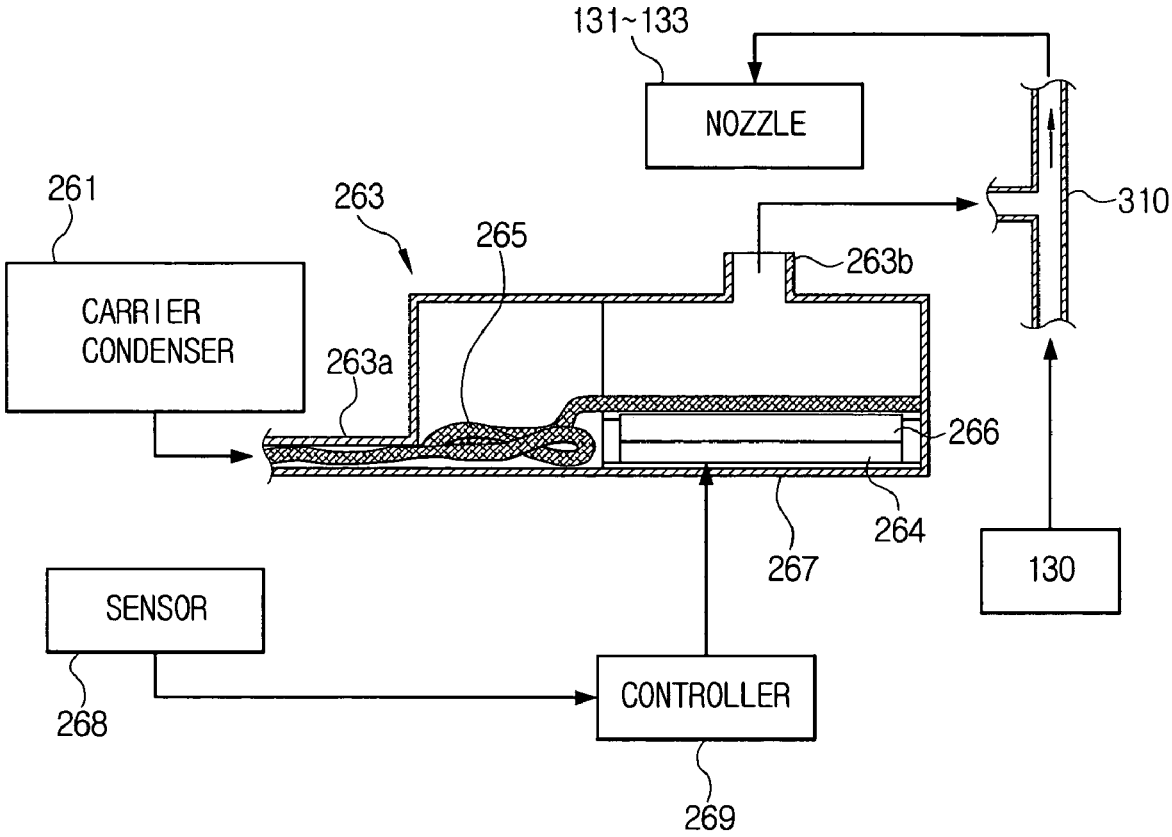
FIG. 5 is a schematic view of a carrier evaporator of FIG. 4 according to an embodiment of the present invention.
Figure 6:
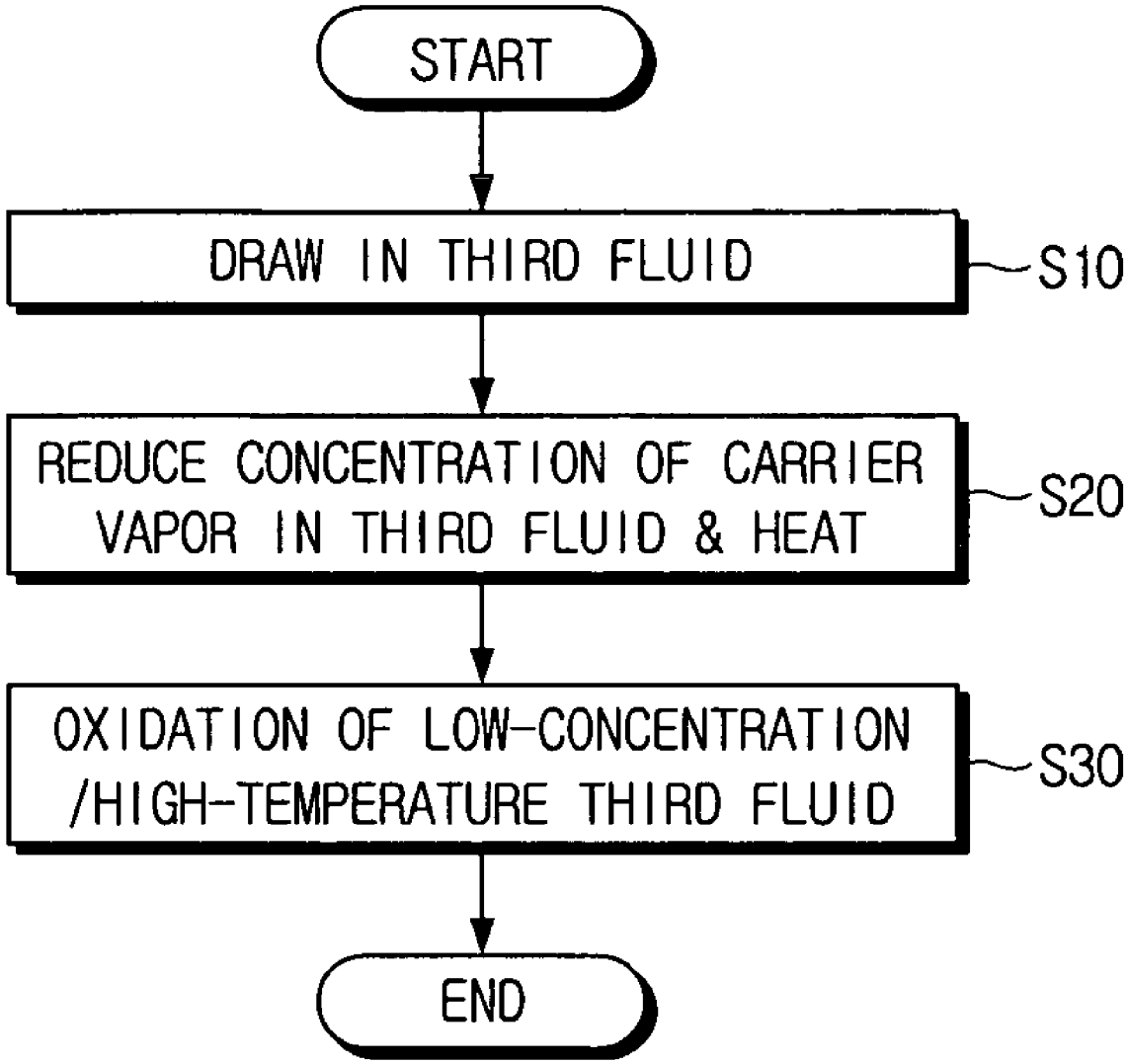
FIGS. 6 and 7 are flowcharts provided for explanation of cleaning method of a wet type electrophotographic image forming apparatus according to an embodiment of the present invention.

Referring to FIG. 5, the carrier evaporator 263 comprises a heating chamber 264, a fabric member 265 housed in the heating chamber 264, a heater 266 and an insulation member 267. The heating chamber 264 is connected to the condenser 261 via a carrier liquid conveyance pipe 263*a*, and also connected to the conveyance pipe 310 via a vapor discharge pipe 263*b*. The fabric member 265 comprises thin and long strands of fiber, and connects the condenser 261 with the heating chamber 264 via the conveyance pipe 263*a*. The carrier liquid of the carrier liquid reservoir 261*a* of the condenser 261 can be conveyed to the heating chamber 264 via the fabric member 265.

The heater 266 is a tubular heater which is formed inside the heating chamber 264. The fabric member 265 is placed on the heater 266. There is the insulation member 267 between the heater 266 and the heating chamber 264. The insulation member 267 blocks the heat of the heater 266 from transmitting to the outside via the heating chamber 264. When the heater 266 is heated, the carrier liquid soaked in the fabric member 265 is heated and vaporized. The carrier vapor is then conveyed to the conveyance pipe 310 via the discharge pipe 263*b*.

The carrier vapor concentration adjustment unit 260 comprises a concentration sensor 268 which measures the concentration of carrier vapor fired through the ejection nozzles 331, 332, 333, and a heater controller 269 which controls the heating amount of the heater 266 according to the concentration of the carrier vapor measured by the concentration sensor 268. The concentration sensor 268 may preferably be formed in the conveyance pipe 310 to measure the concentration of carrier vapor in the second fluid which flows along the conveyance pipe 310. The heater controller 269 determines whether the concentration of the carrier vapor as measured by the concentration sensor 268 equals to, or is smaller than the equivalence ratio of, for example, 1.2. As the heating amount of the heater 266 is properly controlled to increase and decrease, the amount of carrier vapor of the heating chamber 264 can also be properly controlled. As a result, carrier vapor of the second fluid, which is conveyed through the conveyance pipe 310 and ejected, can be maintained above a reference equivalence ratio. Additionally, carrier vapor of the second fluid is always burned completely.

According to the above construction, the third fluid, which is drawn into the duct 141, is heated to a high temperature which reaches approximately more than 300° C. by the combustion heat which is generated as the carrier vapor of the second fluid is burned. Accordingly, the first fluid, which is relatively cold and contains a low concentration carrier vapor and the ozone of the printing engine 120, is mixed with the second fluid incoming from the fusing part 130, into third fluid. Then as the third fluid is heated by the combustion heat of the second fluid, the temperature rapidly rises. And as the carrier vapor of the second fluid burns, the remaining carrier vapor of the incoming air to the oxidation catalyst body 144 is decreased to a lower concentration. Accordingly, power consumption for heating the incoming air to the oxidation catalyst body 144 can be reduced. Additionally, because the carrier vapor decreases to a low concentration at the time of the final stage of cleaning, the capacity requirement for the oxidation catalyst body 144 is reduced. Additionally, the ozone of the discharged air is heated to more than 300° C. and therefore, can be directly decomposed.

A heat exchanger 145 may additionally be provided at the front of the oxidation catalyst body 144 inside the duct 141. The heat exchanger 145 may further comprise an air heater. The heat exchanger 145 raises the temperature of the catalyst itself by transmitting the carrier vapor combustion heat to the catalyst of the oxidation catalyst body 144, and therefore, increases the efficiency of the oxidation catalyst.

In the initial state of the printing, the carrier vapor may be in low concentration, or the temperature of the carrier vapor may be low when the fusing part 130 is incompletely warmed up. In such a situation, the air heater can be driven to raise the temperature by heating the third fluid in the duct 144 and the oxidation catalyst body 144.

The oxidation catalyst body 144 is coated with an oxidation catalyst agent such as platinum (Pt) or palladium (Pd), and is activated at a temperature of 200° C. to accelerate the oxidation process in which carrier vapor, which is flammable hydrocarbon gas, is decomposed into water and carbon dioxide.

A cooling fan 146 may further be provided to cool the high temperature air, after the air is passed through the oxidation catalyst body 144 to remove the ozone and carrier vapor. A plurality of cooling fans 146 may be provided to blow wind toward the outlet of the duct 141.

The operation of a wet type electrophotographic image forming apparatus having the above construction and a cleaning method thereof according to an embodiment of the present invention will be described in greater detail below.

First, when the image forming apparatus 100 begins printing, as shown in FIG. 2, a laser beam is irradiated from the light exposure devices 123*a*, 123*b*, 123*c*, 123*d* onto the surfaces of the respective photosensitive drums 121*a*, 121*b*, 121*c*, 121*d*. Here, the photosensitive drums 121*a*, 121*b*, 121*c*, 121*d* are at predetermined voltage by the electrification of the electrifying devices 122*a*, 122*b*, 122*c*, 122*d*. As the laser beam hits the surfaces, electrostatic latent images are formed on the surfaces of the photosensitive drums 121*a*, 121*b*, 121*c*, 121*d*, and as the developing units 124*a*, 124*b*, 124*c*, 124*d* feed developer of respective colors such as yellow, magenta, cyan and black to the photosensitive drums 121*a*, 121*b*, 121*c*, 121*d*, the latent images are visualized. As a result, visible images in four colors are formed and sequentially transferred onto the transfer belt 126 by the first transfer rollers 127*a*, 127*b*, 127*c*, 127*d*, respectively. As a result, a color image having overlapped four color images is formed on the transfer belt 126. During the above image forming process, the printing medium 'P' is fed from the feeding unit 150 toward the transfer belt 126. When the printing medium 'P' reaches between the transfer belt 126 and the second transfer roller 128, the color image of the transfer belt 126 is transcribed onto the printing medium 'P' via the second transfer roller 128. The printing medium 'P' is then fed toward the fusing part 130.

The printing medium 'P' passes between the heating roller 132 and the pressure belt 133 of the fusing part 130, and discharged outside from the main body 110 of the image forming apparatus via the discharge unit (not shown). When the printing medium 'P' passes between the heating roller 132 and the pressure belt 133, carrier component of the developer on the printing medium 'P' is vaporized by the heat of the heating roller 132, leaving ink component fixed on the printing medium 'P'. Accordingly, the second fluid, which contains a high concentration of carrier vapor and water component, is generated when the printing medium 'P' passes through the fusing part 130.

The first fluid, which contains low concentrations of carrier vapor and ozone from the developer, is also generated at the printing engine 120 in the process of forming a color image on the transfer belt 126. The carrier vapor of the first fluid is relatively in lower concentration and has a lower temperature than the carrier vapor of the second fluid.

The method of cleaning hazardous gases of the printing engine 120 and the fusing part 130 will be described below in greater detail.

Referring to FIGS. 2 to 6, the first fluid from the printing engine 120 and the second fluid from the fusing part 130 are drawn at the same time upon driving of the fan 142, and therefore, mixed in the duct 141 into the third fluid at step S10.

Next, concentration of the carrier vapor of the third fluid of the duct 141 is lowered, and the third fluid is heated at step S20. After being heated, the third fluid is passed through the oxidation catalyst body 144 where it is decomposed by oxidation process into harmless air and then discharged at step S30.

Figure 7:
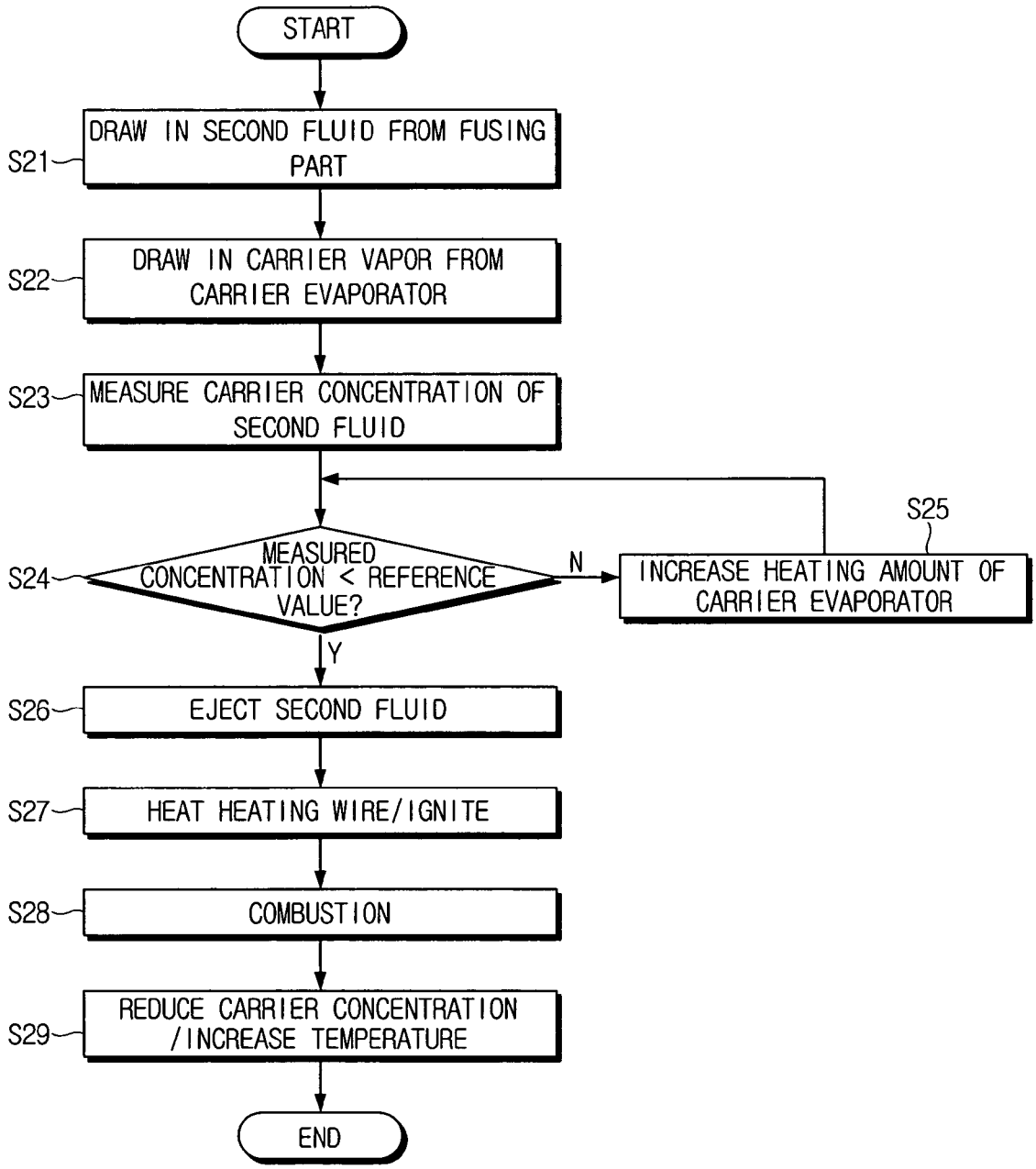

The operation S20 will be described in detail below. Referring to FIG. 7, some of the second fluid is drawn from the fusing part 130 into the duct 141, separately from the third fluid at step S21. The carrier vapor is condensed to liquid in the duct 141, and the carrier liquid is evaporated at the carrier evaporator 263. Accordingly, the carrier vapor of the carrier evaporator 263 are also drawn via the conveyance path 310 at step S22. As described above with reference to FIG. 5, the carrier vapor can be drawn from the carrier evaporator 263, by conveying the carrier liquid of the condenser 161 to the carrier evaporator 363 and heating with the heater 266.

The concentration sensor 268 measures the concentration of the second fluid drawn through the conveyance path 310 at step S23. The heater controller 269 compares and determines whether the measured concentration of the concentration sensor 268 equals to, or less than a predetermined reference value at step S24. If so, the heater controller 269 increases the heating amount of the heater 266 of the carrier evaporator 263 so that the carrier evaporator 263 can produce more carrier vapor at step S25. In other words, it is possible to maintain the concentration of the carrier vapor of the second fluid for perfect burn, for example, it is possible to maintain the equivalence ratio above 1.2.

When the second fluid is drawn into the conveyance path 310, the second fluid is ejected into the duct 141 through the plurality of ejection nozzles 331, 332, 333 by the pumping of the pump 320 at step S26. The streams of the second fluid from the respective nozzles 331, 332, 333 collide at a certain point. The heating wire 250 at the colliding point is heated and therefore, causes the igniter 340 to generate a spark to ignite the second fluid at step S27. Because the ejected second fluid contains high concentrations of carrier vapor which is more than the equivalence ratio of 1, the second fluid immediately burns upon ignition and burns completely at step S28. As the carrier vapor of the ejected second fluid burns, some of the third fluid of the duct 141 also burns. Accordingly, the concentration of the carrier vapor decreases, and the temperature of the third fluid rapidly rises due to the combustion heat. Because the temperature of the third fluid rises more than approximately 300° C., ozone is completely decomposed from the third fluid. The carrier vapor is decreased to lower concentration and heated to high temperature, and oxidized while it passes through the oxidation catalyst body 144 at step S29.

The combustion heat is transmitted to the oxidation catalyst body 144 via the heat exchanger 145, and therefore, increases the temperature of the catalyst. As a result, oxidation of the carrier vapor can be accelerated.

The air heater of the heat exchanger 145 is driven at the initial state of the printing to warm up the oxidation catalyst body 144, and also heat the air which is flowed to the oxidation catalyst body 144. Accordingly, during active combustion of the carrier vapor, it is not necessary to drive the air heater of the heat exchange 145.

As described above, the carrier vapor of high concentration is reduced in the duct 141 to a certain level, and therefore, the load to the oxidation catalyst can be reduced.

Accordingly, the oxidation catalyst, which is relatively expensive, can be employed less and cost can be reduced.

Additionally, the combustion heat of the carrier vapor is utilized for more efficient performance of the catalyst. Therefore, requirements for capacity of driving voltage of the air heater can be reduced, and maintenance can be lowered.

Additionally, because the carrier liquid of the duct is evaporated and removed, no separate space is required for the storage of carrier liquid. Therefore, the entire size of the image forming apparatus can be reduced.

In conclusion, the image forming apparatus as described above with reference to a few exemplary embodiments of the present invention can satisfy essential requirements for economic cost, size and power consumption, for the commercialization of the wet type electrophotographic image forming apparatuses for use in homes, shops, or industrial fields.

The foregoing embodiment and advantages are merely exemplary and are not to be construed as limiting the present invention. The present teaching can be readily applied to other types of apparatuses. Further, the description of the embodiments of the present invention is intended to be illustrative, and not to limit the scope of the claims, and many alternatives, modifications, and variations will be apparent to those skilled in the art.

What is claimed is:

1. A cleaning apparatus for use in a wet type electrophotographic image forming apparatus, the cleaning apparatus comprising:

a duct for guiding a fluid to the outside, the fluid containing an ozone and a carrier vapor which are respectively generated from a fusing part and a printing engine having a developing unit and a transfer unit;

a fan for forcibly discharging the fluid through the duct;

a carrier vapor combustion unit for burning a high concentration of carrier vapor of the fusing part inside the duct and accordingly lowering the concentration and increasing the temperature of the carrier vapor of the fluid which is circulated by the fan, wherein said carrier vapor combustion unit comprises an igniter for sparking the carrier vapor; and an oxidation catalyst body for increasing a rate of the oxidation of the fluid which is heated by the combustion unit.

2. The cleaning apparatus of claim 1, wherein the carrier vapor combustion unit further comprises:

a carrier vapor conveyance path for guiding the high concentration of carrier vapor of the fusing part into a predetermined location of the duct;

a pump which is formed on the conveyance path for forcibly conveying the carrier vapor;

one or more ejection nozzles which are provided at an end of the conveyance path for firing the carrier vapor; and wherein the igniter sparks the carrier vapor when the carrier vapor is ejected through the ejection nozzle.

3. The cleaning apparatus of claim 2, wherein the carrier vapor combustion unit further comprises a heating wire which is formed adjacent to the ejection nozzles and maintained at a predetermined heated temperature.

4. The cleaning apparatus of claim 2, wherein a plurality of ejection nozzles are provided in a predetermined arrangement such that carrier vapor ejected from the respective ejection nozzles collide with each other.

5. The cleaning apparatus of claim 1, further comprising a carrier vapor concentration adjustment unit which increases the concentration of the carrier vapor for combustion at the carrier vapor combustion unit.

6. The cleaning apparatus of claim 5, wherein the carrier vapor concentration adjustment unit comprises:

a carrier vapor condenser for liquefying some of the fluid which is supplied into the duct; and a carrier evaporator for heating the liquefied carrier of the condenser and supplying it to the carrier vapor combustion unit.

7. The cleaning apparatus of claim 6, wherein the evaporator comprises:

a heating chamber which is connected with the condenser and the carrier vapor combustion unit, respectively;

a fabric member for conveying the liquefied carrier of the condenser into the heating chamber; and a heater which is formed in the heating chamber for heating the liquefied carrier soaked in the fabric member.

8. The cleaning apparatus of claim 7, wherein the carrier vapor concentration adjustment unit further comprises:

a concentration sensor for measuring the concentration of the carrier vapor being ejected from the ejection nozzles; and a heater controller for adjusting the heating amount of the heater in accordance with the measured carrier concentration of the concentration sensor.

9. The cleaning apparatus of claim 7, wherein the evaporator further comprises an insulation member which is formed in the heating chamber for blocking the heat of the heater from leaking to the outside.

10. The cleaning apparatus of claim 1, further comprising an air heater for heats the fluid flowing to the oxidation catalyst body.

11. The cleaning apparatus of claim 1, further comprising a heat exchanger for transmitting a heat to the oxidation catalyst body, the heat being generated from the combustion of the carrier vapor combustion unit.

12. A wet type electrophotographic image forming apparatus comprising:

a main body;

a printing engine provided in the main body, and comprising a developing unit for attaching a developer liquid containing an ink and a carrier onto an image bearing body, and a transfer unit for transferring the developer liquid of the image bearing body onto a printing medium;

a fusing part for fixing the transferred developer liquid onto the printing medium with heat and pressure; and a cleaning apparatus for removing an ozone and a carrier vapor being generated from the printing engine and the fusing part, the cleaning apparatus comprising:

a duct for guiding a fluid to the outside, the fluid containing an ozone and a carrier vapor which are respectively generated from the fusing part and the printing engine, a fan for forcibly discharging the fluid through the duct, a carrier vapor combustion unit for burning a high concentration of carrier vapor of the fusing part inside the duct and accordingly lowering the concentration and increasing the temperature of the carrier vapor of the fluid which is circulated by the fan, and an oxidation catalyst body for increasing a rate of the oxidation of the fluid which is heated by the combustion unit, wherein said carrier vapor combustion unit comprises an igniter for sparking the carrier vapor.

13. The electrophotographic image forming apparatus of claim 12, wherein the carrier vapor combustion unit further comprises:

a carrier vapor conveyance path for guiding the high concentration of carrier vapor of the fusing part into a predetermined location of the duct;

a pump which is formed on the conveyance path for forcibly conveying the carrier vapor;

one or more ejection nozzles which are provided at an end of the conveyance path for firing the carrier vapor; and wherein the igniter sparks the carrier vapor when the carrier vapor is ejected through the ejection nozzle.

14. The electrophotographic image forming apparatus of claim 13, wherein the carrier vapor combustion unit further comprises a heating wire which is formed in adjacent to the ejection nozzles and maintained at a predetermined heated temperature.

15. The electrophotographic image forming apparatus of claim 13, wherein a plurality of ejection nozzles are provided in a predetermined arrangement such that carrier vapor ejected from the respective ejection nozzles collide with each other.

16. The electrophotographic image forming apparatus of claim 12, further comprising a carrier vapor concentration adjustment unit which increases the concentration of the carrier vapor for combustion at the carrier vapor combustion unit.

17. The electrophotographic image forming apparatus of claim 16, wherein the carrier vapor concentration adjustment unit comprises:

a carrier vapor condenser for liquefying some of the fluid which is supplied into the duct; and a carrier evaporator for heating the liquefied carrier of the condenser and supplying it to the carrier vapor combustion unit.

18. The electrophotographic image forming apparatus of claim 17, wherein the evaporator comprises:

a heating chamber which is connected with the condenser and the carrier vapor combustion unit, respectively;

a fabric member for conveying the liquefied carrier of the condenser into the heating chamber; and a heater which is formed in the heating chamber for heating the liquefied carrier soaked in the fabric member.

19. The electrophotographic image forming apparatus of claim 18, wherein the evaporator further comprises an insulation member which is formed in the heating chamber to block the heat of the heater from leaking to the outside.

20. The electrophotographic image forming apparatus of claim 17, wherein the carrier vapor concentration adjustment unit further comprises:

a concentration sensor for measuring the concentration of the carrier vapor being ejected from the ejection nozzles; and a heater controller for adjusting the heating amount of the heater in accordance with the measured carrier concentration of the concentration sensor.

21. The electrophotographic image forming apparatus of claim 12, further comprising an air heater for heating the fluid flowing to the oxidation catalyst body.

22. The electrophotographic image forming apparatus of claim 12, further comprising a heat exchanger for transmitting heat to the oxidation catalyst body, the heat being generated from the combustion of the carrier vapor combustion unit.

* * * * *